US007234996B1

(12) United States Patent
Donker

(10) Patent No.: US 7,234,996 B1
(45) Date of Patent: Jun. 26, 2007

(54) BRASSIERE HAVING POCKET WITH WRITING RECEIVING SUBSTRATE DISPOSED THEREIN

(76) Inventor: Christine Donker, 629 Chase Tree St., Las Vegas, NV (US) 89144

( * ) Notice: Subject to any disclaimer, the term of this patent is extended or adjusted under 35 U.S.C. 154(b) by 0 days.

(21) Appl. No.: 11/033,193

(22) Filed: Jan. 11, 2005

Related U.S. Application Data

(60) Provisional application No. 60/536,206, filed on Jan. 13, 2004.

(51) Int. Cl.
*A41C 3/10* (2006.01)
*A41C 3/00* (2006.01)
*A41C 3/12* (2006.01)

(52) U.S. Cl. ..... 450/89; 450/1

(58) Field of Classification Search ..... 450/1, 450/54–58, 89, 92, 93, 7–10, 17, 19, 30, 450/36; 2/244, 246, 243.1, 69, 67, 105, 106, 2/113, 115; 40/586
See application file for complete search history.

(56) References Cited

U.S. PATENT DOCUMENTS 3,029,938 A * 4/1962 Soltz ..... 206/278
3,055,133 A * 9/1962 Anderson ..... 40/586
3,837,476 A * 9/1974 Schwartz ..... 206/45.24
4,627,110 A * 12/1986 Tengs ..... 2/69
4,710,981 A * 12/1987 Sanchez ..... 2/115
6,023,790 A * 2/2000 Schwartz ..... 2/247
6,174,217 B1 * 1/2001 Judson ..... 450/1
6,185,746 B1 * 2/2001 Scott ..... 2/115

* cited by examiner

*Primary Examiner*—Gloria M. Hale
(74) *Attorney, Agent, or Firm*—Parsons & Goltry; Michael W. Goltry; Robert A. Parsons

(57) ABSTRACT

A brassiere has two breast-receiving cups each having an inner breast-receiving surface and an opposing outer surface. A pocket component is affixed to the outer surface of one of the breast-receiving cups. The pocket component opposes a portion of the outer surface of the one of the breast-receiving cups. The pocket component and the portion of the outer surface of the one of the breast-receiving cups forms a storage space having a first shape and an opening into the storage space. A substrate, having a second shape, is disposed in the storage space and is capable of accepting writing applied thereto by a writing instrument, in which the substrate is removable from the storage space through the opening. The second shape of the substrate conforms substantially to the first shape of the storage space.

2 Claims, 3 Drawing Sheets

FIGURE 5A
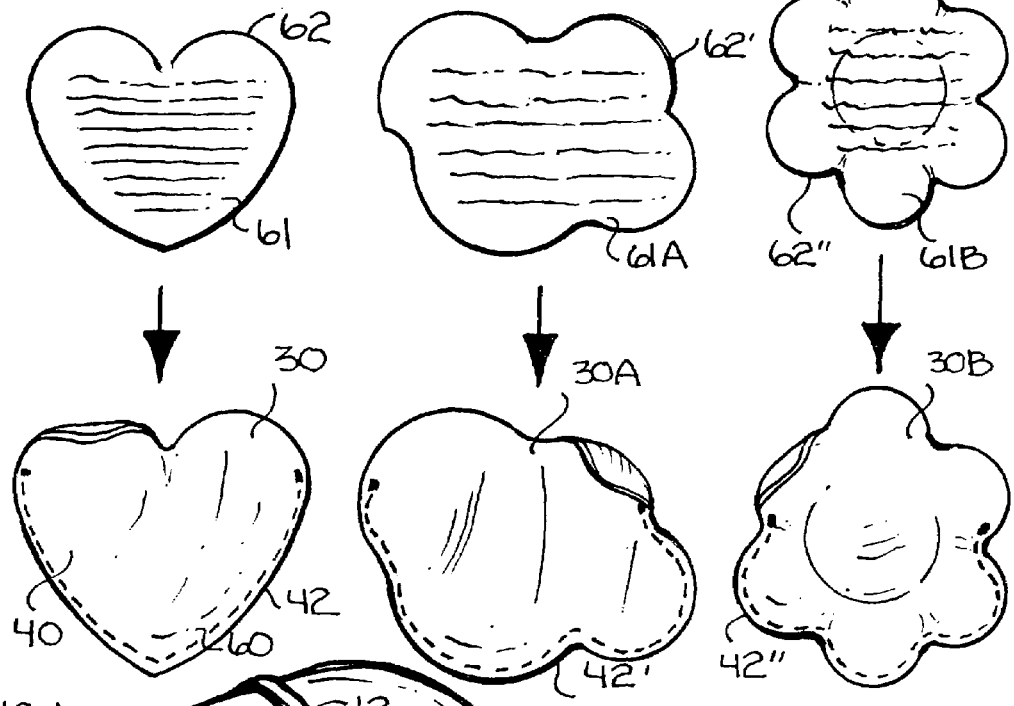
FIGURE 5B
FIGURE 5C
FIGURE 4
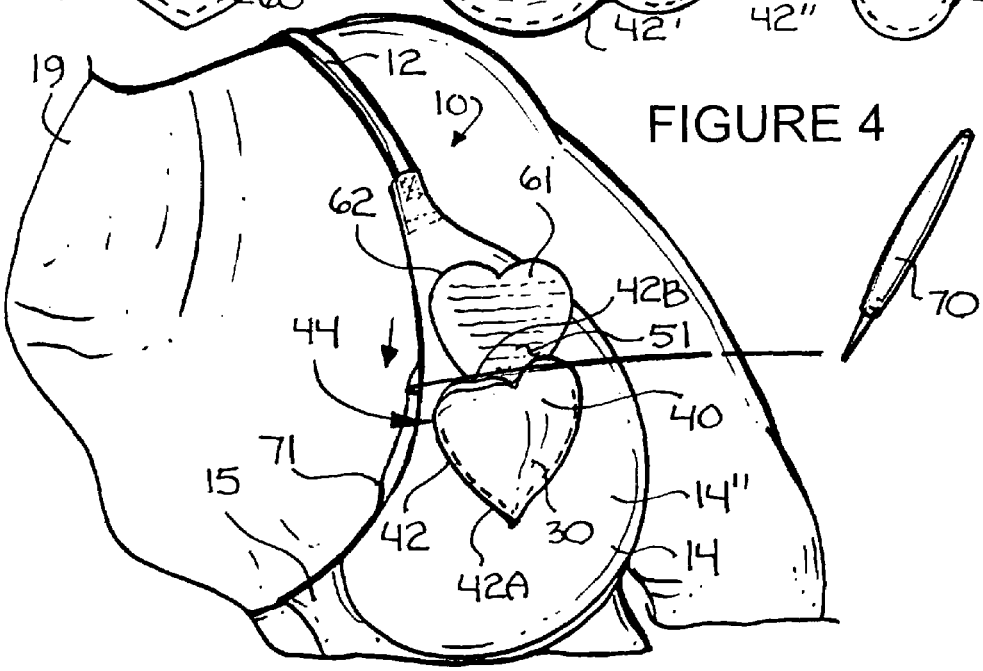

FIGURE 6
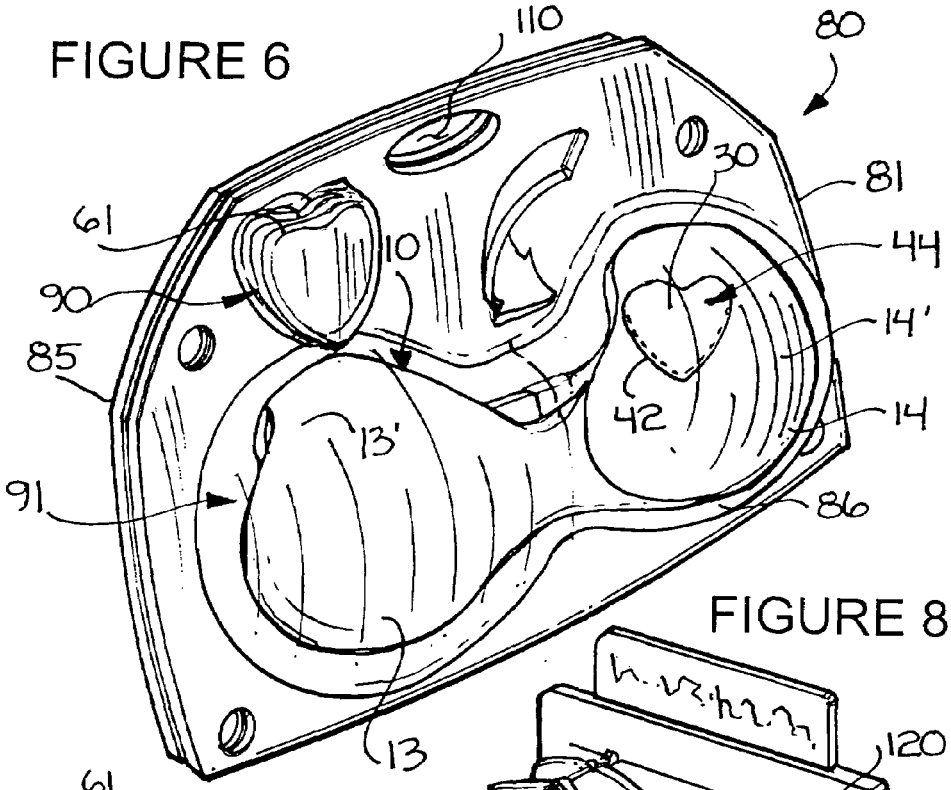
FIGURE 8
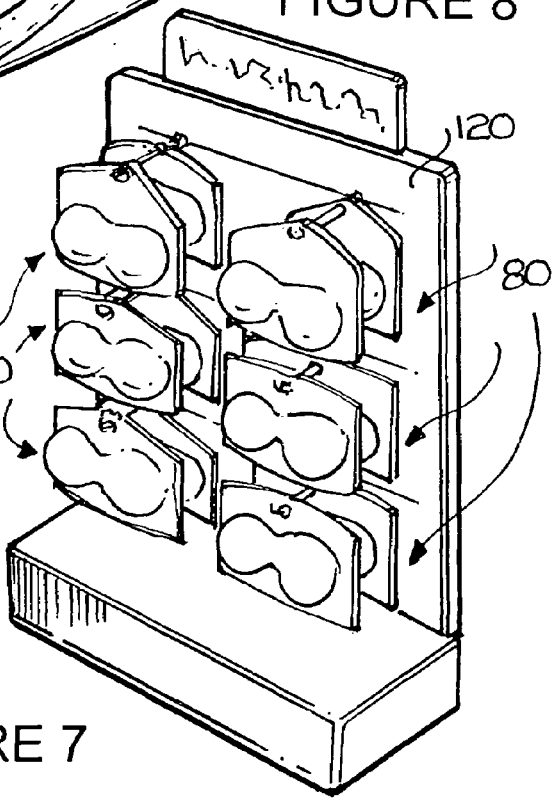
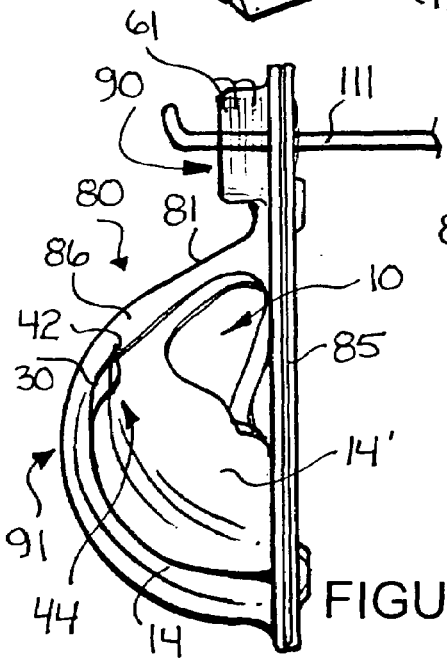
FIGURE 7

BRASSIERE HAVING POCKET WITH WRITING RECEIVING SUBSTRATE DISPOSED THEREIN

CROSS-REFERENCE TO RELATED APPLICATION

This application claims the priority of U.S. Provisional Patent Application Ser. No. 60/536,206, filed Jan. 13, 2004.

FIELD OF THE INVENTION

The present invention relates undergarments and, more particularly, to women's undergarments and especially brassieres.

BACKGROUND OF THE INVENTION

A brassiere or bra is a foundation garment for women consisting of shoulder straps, two cups, a center panel, an underbust band, sides, and a back. Bra types are quite varied, depending on style, function, and materials. Styles include front-closure, back-closure, strapless, convertible, push-up, demi-bra, full-cup, three-quarters cup, half-cup, longline, underwire, padded, triangle, soft-cup, shelf-bra, and T-shirt.

The concept of covering or restraining the breasts dates back to 6,500 years in Greece. Minoan women on the island of Crete 4,500 years ago wore brassieres that revealed their bare breasts. A binding known as an apodesmos or mastodeton was worn by Greek women for exercise. It is said that brassieres were invented by men so that women's breasts would be smaller, more like a man's.

A bra-like device to give a "symmetrical rotundity" to the breasts was patented in 1859 by Henry S. Lesher of Brooklyn, N.Y. Although the bra invented by Mr. Lesher is clearly a bra in design, it was uncomfortable to wear by current standards.

In 1889 Herminie Cadolle of France invented the first modern bra that was a two-piece undergarment including a corset for the waist an upper support for supporting the breasts by means of shoulder straps. By 1905 the upper half was being sold separately. In the United States, Mary Phelps Jacob was granted the first U.S. patent for the brassiere in 1913. Her invention is most widely recognized as the predecessor to the modern bra.

The history of the brassiere is indeed colorful, and numerous brassieres have been recently devised that actually provide breast enhancement. Other than this, little has been done to increase the utility of brassieres beyond their primary use as a breast support.

SUMMARY OF THE INVENTION

According to the invention, provided is a brassiere, and a pocket component affixed to the brassier. The pocket component opposes a portion of the brassiere, in which the pocket component and the portion of the brassiere form a storage space and an opening into the storage space. A substrate is disposed in the pocket, and is capable of accepting writing applied thereto by a writing instrument, the substrate being removable from the storage space through the opening. The storage space has a first shape, the substrate has a second shape, and the second shape conforms substantially to the first shape. The cups each have an inner breast-receiving surface and an opposing outer surface. Further to this embodiment, the pocket component is affixed to the outer surface of one of the breast-receiving cups, and the portion of the brassiere further includes a portion of the outer surface of the one of the breast-receiving cups.

According to the invention, a brassiere is provided, which has two breast-receiving cups each having an inner breast-receiving surface and an opposing outer surface. A pocket component is affixed to the outer surface of one of the breast-receiving cups. The pocket component opposes a portion of the outer surface of the one of the breast-receiving cups. The pocket component and the portion of the outer surface of the one of the breast-receiving cups form a storage space and an opening into the storage space. A substrate is disposed in the pocket, and is capable of accepting writing applied thereto by a writing instrument, the substrate being removable from the storage space through the opening. The storage space has a first shape, and the substrate has a second shape, in which the second shape conforms substantially to the first shape.

According to the invention, a prepackaged garment assembly is provided, which includes a brassiere having two breast-receiving cups each having an inner breast-receiving surface and an opposing outer surface. A pocket component is affixed to the outer surface of one of the breast-receiving cups. The pocket component opposes a portion of the outer surface of the one of the breast-receiving cups. The pocket component and the portion of the outer surface of the one of the breast-receiving cups forms a storage space and an opening into the storage space. A substrate capable of accepting writing applied thereto by a writing instrument is also provided. The storage space is capable of accepting the substrate through the opening. According to the invention, exterior packaging encloses the brassiere and the substrate. The storage space has a first shape, and the substrate has a second shape, in which the second shape conforms substantially to the first shape. In one embodiment, the exterior packaging is substantially clear. In another embodiment, the exterior packaging includes a back face and an opposing customer-viewing face, wherein the customer-viewing face is substantially clear and the brassiere and the substrate are positioned in the exterior packaging permitting them to be visualized through the customer-viewing face.

According to the invention, a prepackaged garment assembly is provided, which includes a brassiere having two breast-receiving cups each having an inner breast-receiving surface and an opposing outer surface. A pocket component is affixed to the outer surface of one of the breast-receiving cups. The pocket component opposes a portion of the outer surface of the one of the breast-receiving cups. The pocket component and the portion of the outer surface of the one of the breast-receiving cups forms a storage space and an opening into the storage space. The pocket component has a perimeter edge defining a shape. A substrate is also provided, which is capable of accepting writing applied thereto by a writing instrument. The storage space is capable of accepting the substrate through the opening. According to the invention, exterior packaging encloses the brassiere and the substrate. The exterior packing includes a back face and an opposing substantially clear customer-viewing face. The brassiere is positioned in the exterior packaging permitting the shape defined by the perimeter edge of the pocket component to be visualized through the customer-viewing space. In another embodiment, the substrate is positioned in the exterior packaging permitting the substrate to be visualized through the customer-viewing face. The storage space has a first shape, and the substrate has a second shape, in which the second shape conforms substantially to the first shape.

Consistent with the foregoing summary of preferred embodiments of the invention, and the ensuing specification, which are intended to be taken together, the invention also contemplates associated apparatus and method embodiments.

BRIEF DESCRIPTION OF THE DRAWINGS

Referring to the drawings:

FIG. 4 is a fragmented perspective view of the brassiere of FIG. 1 showing the substrate partially disposed in the pocket;

FIGS. 5A-5C are examples of different shapes of pockets and substrates that are capable of being employed with a brassiere constructed and arranged in accordance with the principles of the invention;

FIG. 6 is a perspective view of a prepackaged garment assembly constructed and arranged in accordance with the principles of the invention;

FIG. 7 is a side elevational view of the prepackaged garment assembly of FIG. 6 shown as it would appear engaged to, and depending from, a support; and FIG. 8 is a perspective view of a plurality of prepackaged garment assemblies, each constructed and arranged in accordance with the prepackaged garment assembly of FIG. 6, show held by a displace case.

DETAILED DESCRIPTION OF A PREFERRED EMBODIMENT

Figure 1:
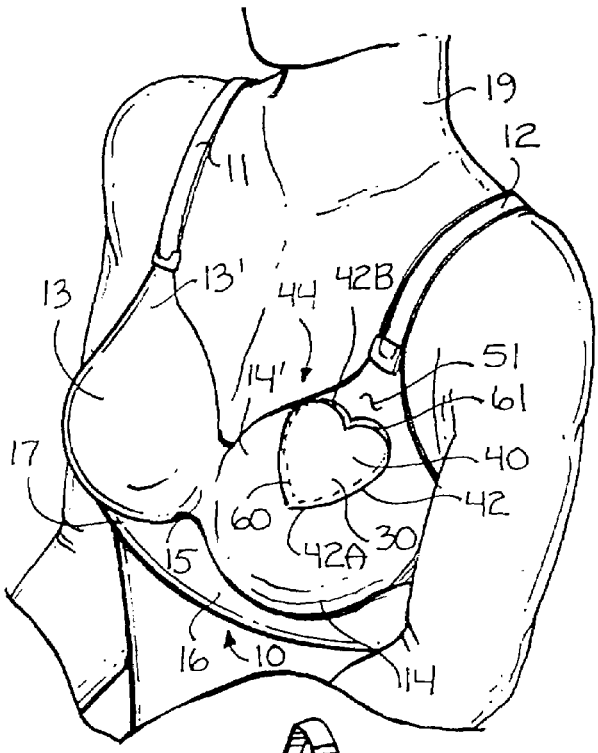
FIG. 1 is a perspective view of a brassiere constructed and arranged in accordance with the principles of the invention, the brassiere including a substrate capable of accepting writing from a writing instrument disposed in a pocket carried by the brassiere.
Figure 3:
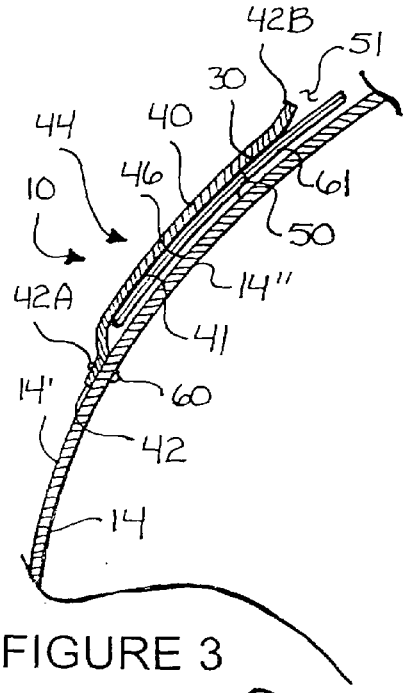
FIG. 3 is a sectional view taken along line 3-3 of FIG. 2.
Figure 2:
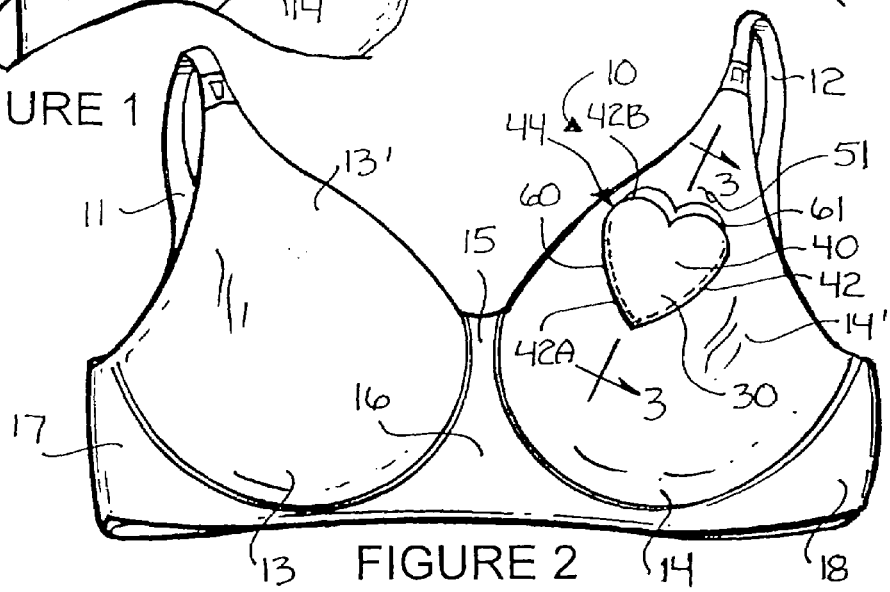
FIG. 2 is a front elevational view of the brassiere of FIG. 1.

Turning now to the drawings, in which like reference characters indicate corresponding elements throughout the several views, attention is first directed to FIGS. 1 and 2 in which there is seen a brassiere 10 constructed and arranged in accordance with the principle of the invention. With continuing reference to FIG. 1 and additional reference to FIG. 2, brassiere 10 is a foundation garment for a woman consisting of shoulder straps 11 and 12, two cups 13 and 14, a center panel 15 between cups 13 and 14, an underbust band 16 underlying cups 13 and 14, sides 17 and 18, and a back (not shown). Cups 13 and 14 each have an inner breast-receiving surface (not shown), and an opposing outer surface 13' and 14'. FIG. 3 is a sectional view taken along line 3-3 of FIG. 2, illustrating outer surface 14' of cup 14, in addition to its opposing inner breast-receiving surface 14". Surface 14' is generally convex, and surface 14" is generally concave so as to receive a breast. The inner breast-receiving surface of cup 13 is similarly arranged. Typically, the back of brassiere 10 will include a clasp or closure assembly for permitting brassiere 10 to be easily installed in place and removed, being exemplary of a back-closure style of brassiere. Brassiere 10 is fashioned of cotton, polyester, silk, or other material or combination of materials as with conventional brassieres. In FIG. 1, brassiere 10 is shown as it would appear being worn by a female user 19 providing breast coverage and support.

Set forth for the purpose of orientation and reference in conjunction with the ensuing disclosure, brassiere 10 is generally representative of a conventional brassiere of the type which is adapted to be worn by a woman for providing breast coverage and support. Various details of brassiere 10 not herein specifically discussed will readily occur to those skilled in the art and will not be further discussed except to the extent necessary to make a full and complete disclosure of the invention. Furthermore, bra types are quite varied, depending on style, function, and materials. Accordingly, brassiere 10 can be fashioned of any suitable style as may be desired, in which such styles can include a front-closure style, a back-closure style, a strapless style, a convertible style, a push-up style, a demi-bra style, a full-cup style, three-quarters cup style, a half-cup style, a longline style, an underwire style, a padded style, a triangle style, a soft-cup style, a shelf-bra style, a T-shirt style, etc.

With continuing reference to FIGS. 1 and 3, and additional reference to FIG. 4, brassiere 10 further includes a pocket component 30 and a substrate 31. According to the principle of the invention, a pocket component 30 is provided, which, according to the principles of the invention, is affixed to outer surface 14" of cup 14 forming a pocket, which is denoted generally at 44. Pocket component 30 is preferably fashioned of a fabric made of cotton, polyester, wool, nylon, silk, or other fabric material or combination of fabric materials. Component 30 can be made of other materials, such as plastic, polyethylene, or other similar materials or combination of materials.

Pocket component 30 is generally flat and has an outer face 40 and an opposing inner face 41, which is shown only in FIG. 3. Pocket component 30 has a perimeter edge 42, a lower edge portion 42A thereof being affixed to outer surface 14' and an upper edge portion 42B thereof being unaffixed to outer surface 14'. Considering FIG. 3, inner face 41 and upper edge portion 42B of pocket component 30 confront and oppose a portion 46 of outer surface 14' of cup 14, in which inner face 41 of pocket component 30 and portion 46 of outer surface 14' of cup 14 cooperate forming a storage space 50, and upper edge portion 42B and the opposing part of portion 46 of outer surface 14' of cup 14 cooperate forming an opening 51 into storage space 50, in which pocket 44 is formed.

Perimeter edge 42 defines a shape of pocket component 30, which, in the immediate embodiment, is that of a heart as shown. Because pocket component 30 is affixed to outer surface 14' of pocket 14, its shape as defined by perimeter edge 42 is readily visualized and appreciated by gazing upon outer surface 14' of cup, according to the principle of the invention. FIG. 5A is an enlarged front elevational view of pocket component 30 illustrating its heart shape as defined by perimeter edge 42. Because pocket component 30 is generally heart-shaped, storage space 50 is also generally heart-shaped in this embodiment. Other shapes for pocket component 30 can be used, if desired, and FIGS. 5B and 5C show two examples of different shapes of pocket components that can be used with the invention. As a matter of example, FIG. 5B shows a pocket component 30A having a perimeter edge 42' defining an irregular shape of pocket component 30A, and FIG. 5C shows a pocket component 30B having a perimeter edge 42" defining a general flower shape of pocket component 30B. Other shapes can be used, such as triangular shapes, round shapes, oval shapes, etc.

Although the shape of pocket component 30 and storage space 50 are essentially the same, they can be different if desired, and this will all depend not only on the shape of pocket component 30 but also how it is affixed to outer surface 14' of cup 14. For instance, although a pocket component used in conjunction with the invention may have a particular shape defined by its perimeter edge, the portion of it actually affixed to a brassiere cup can, if desired, form shape of the storage space which is different from the shape as defined by the perimeter edge of the pocket component.

Referring to FIGS. 1-5A, lower edge portion 42B of perimeter edge is affixed by way of sewing as indicated by seam 60. Lower edge portion 42B can be affixed to outer surface 14' of cup 14 in other ways, such as by sewing, heat-bonding, etc. In this embodiment, seam 60 defined an attachment point of pocket component 30 to outer surface 14' of cup 14 such that storage space 50 takes on a generally heart shape.

As seen in FIGS. 1-3, a substrate 61 is also provided, which is to be placed into and held by pocket 44. Substrate 61 is a sheet of material that is capable of accepting writing from a writing utensil, such as a pencil, pen, crayon, colored pencil, etc. Accordingly, substrate 61 is fashioned of paper, plastic, paper or other material that has been treated so that it accept writing from a writing utensil and yet that is also water or moisture resistant, etc. Other materials that are capable of accepting writing from a writing utensil can be used without departing from the invention. Also, although substrate 61 is a single piece of material in the instant embodiment, substrate 61 can be provided in the form of a pad of sheets of material which are bound or held at one edge, in which case it is to be understood that the term "substrate" is intended to include not only a single sheet of material but also sheets of material which are bound together so as to form a pad. A plurality of "loose" substrates can be provided and positioned in pocket 44, if desired.

According to the invention as shown in FIGS. 1-3, substrate 61 is disposed in storage space 50 so as to be held by pocket 44. Referring to FIG. 5A, substrate 61 has a perimeter edge 62 that defines a shape of substrate 61. Preferably, the shape of substrate 61 as defined by its perimeter edge 62 conforms substantially to the shape of storage space 50. Because storage space 50 is substantially heart shaped as previously described, the shape of substrate 61 as defined by its perimeter edge 62 is also similarly heart shaped, conforming substantially to that of storage space 50. To place substrate 61 in storage space 50, it is simply taken up, such as by hand, and passed into storage space 50 through opening 51, such then when positioned in storage space 50 its shape will conform to that of storage space 50 as herein described. Preferably, the shape of substrate 61 conforms also to that of pocket component 30, although the shapes thereof can be different, if desired. As a matter of example, FIG. 5B shows a substrate 61A having a perimeter edge 62' defining a shape thereof which is designed to fit into the storage space defined by pocket component 30A, and FIG. 5C shows a substrate 61B having a perimeter edge 62" defining a shape thereof which is designed to fit into the storage space defined by pocket component 30B.

Pocket 44 can, if desired, incorporate a closure assembly for opening 51, such as a hook and loop fastener system including an element thereof carried by upper edge portion 42B and a complemental element thereof carried by the opposing part of portion 46, a snap engagement structure including an element thereof carried by upper edge portion 42B and a complemental element thereof carried by the opposing part of portion 46, or other suitable closure assembly permitting opening 51 to be opened and closed as needed.

The combination of pocket 44 and substrate 61 with brassiere 10 is important, in that pocket 44 provides a convenient storage place for substrate 61, and substrate 61 can be taken up and used by the wearer of brassiere for taking notes, ideas, phone numbers, names, addresses, email addresses, goals, affirmations, prayers, etc., in those instances when no other pieces of paper or objects capable of accepting writing from a writing instrument are otherwise available. The location of pocket 44 and substrate 61 at cup 14 provides a convenient access point for substrate 61. In other words, positioning substrate 61 for storage at outer surface 14' of cup 14 allows a user to easily reach down to access and take up substrate 61 from pocket 44, such as through the collar or other opening in an outer garment, and then also place substrate 61 back into pocket after it is used to take writing from a writing utensil. Furthermore, because substrate 61 is held and disposed at cup 14, it is prevented from becoming damaged and crumpled, which is found to occur when writable substrates, such as paper and the like, are stored in conventional spots on a person, such as in a pocket of trousers, pants, shorts, skirts, and dresses. Provided a user wearing brassiere 10 has a writing utensil or access to a writing utensil, the provision of substrate 61 held in pocket 44 in combination with brassiere 10 is highly desirable and advantageous combination.

In FIG. 4, a writing utensil 70 is shown as a matter of example, which may be a pen, or a pencil, or other writing device. If desired, brassiere can be furnished with an auxiliary pocket 71 for use in storing writing utensil 70. In the embodiment set forth in FIG. 4, auxiliary pocket 71 is formed on the upper edge of cup 14, and it is to be understood that it can be located elsewhere on brassiere 10.

According to a preferred embodiment, it is preferred that pocket 44 be formed at outer surface 14' of cup 14. Pocket 44 can be similarly formed at inner surface 14" of cup 14, if desired, but this may cause some discomfort against a breast positioned against inner surface 14" unlike the case in which the pocket 44 and substrate 61 combination are formed at outer surface 14'. It is to be understood that although the pocket 44 and substrate 61 combination have been discussed on conjunction with cup 14, this combination can be similarly provided with respect to cup 13, and provided in conjunction with outer surface 13' of cup 13 in a preferred embodiment, or with the inner breast receiving surface of cup 13, if desired, with the understanding that but the latter may cause some discomfort against a breast positioned against the inner breast receiving surface of cup 13 unlike the case in which the pocket 44 and substrate 61 combination are formed at outer surface 13'. Furthermore, although brassiere 10 is discussed in conjunction with one pocket 44 and substrate 61 combination, brassiere 10 can be made to incorporate more pocket 44 and substrate 61 combinations, if desired.

According to the invention, a brassiere with a pocket and a substrate combination all constructed and arranged in accordance with the invention can be prepackaged as a prepackaged garment assembly, and FIG. 6 illustrates just such an embodiment of a prepackaged garment assembly designated generally at 80. Prepackaged garment assembly 80 includes exterior packaging 81 which encloses brassiere 10 and also a plurality of substrates each designated at 61. Exterior packaging 81 maintains brassiere 10 and substrates 61 at separate locations, namely, compartments 90 and 91 of exterior packaging 81, which are each sized and arranged to hold substrates 61 on the one hand, and brassiere 10 on the other hand. Although exterior packaging incorporates a plurality of substrates 61, only one can be provided. A substrate can also be positioned and held in pocket 44, if desired.

Exterior packaging 81 includes two components, namely, a back element or face 85 and an opposing front element or customer-viewing face 86, which is substantially clear being made of clear plastic or other clear exterior packaging material. Preferably, both back face 85 and front face 86 are fashioned of clear material, but back face 85 can be made of an opaque material, if desired. Back face 85 and front face 86 are brought together capturing and containing therein brassiere 10 and substrates 61, in which their perimeter edges are bound together, such as by heat bonding, gluing, tabs, connectors, or by way of some other conventional system exemplary of similar such exterior packaging thus forming exterior packaging 81. Exterior packing of this general type is commonly found used in the packaging of many consumer items, including toys, electronic devices, etc. Exterior packaging 81 includes compartment 90 for containing substrates 61, and compartment 91 for containing brassiere 10, in which compartments 90 and 91 are different from one another. Front face 86 substantially forms compartments 90 and 91, substrates 61 and brassiere 10 each being capable of being visualized therethrough according to the principles of the invention.

According to the invention, brassiere 10 and substrates 61 are disposed in exterior packaging 81 so that they may be visualized through front face 86. This allows a merchant to display prepackaged garment assemblies constructed in accordance with the principle of the invention in a display unit allowing potential customers to see brassiere 10 and substrates 61 for sparking their attention to the product in order to garner its attention as an item to be purchased and distinguishing it from other sale items. Preferably, brassiere 10 is positioned in exterior packaging 81 so that outer surfaces 13' and 14' of cups 13 and 14 are presented outwardly toward the inner surface of front face 86 so as to be visualized through front face 86, and so that pocket 44 is also easily visualized through front face 86. As seen in FIG. 8, the shape of pocket 44 as defined by perimeter edge 42 of pocket component 30 is also readily visualized through front face 86, which permits onlookers to readily visualize the shape and form of pocket 44 and its accompaniment or incorporation with brassiere 10.

Prepackaged garment assemblies constructed in accordance with the principle of the invention may be displayed in a display case or unit, by either laying the assemblies onto a display case or unit, hanging the assemblies from a display case or unit, etc. As a matter of example, exterior packaging 81 may be fashioned with a hanger feature or opening 110 therethrough to, as seen FIG. 7, receive or otherwise accept a hanger 111 for hanging or suspending prepackaged garment assembly 80. As a matter of example, FIG. 8 illustrates a display case 120 having a plurality of prepackaged garment assemblies 80 each constructed and arranged in accordance with the principle of the invention shown as they would appear hung thereon and displayed for sale. Any suitable system for hanging a prepackaged garment assembly constructed and arranged in accordance with the invention may be used without departing from the teachings set forth herein.

The present invention is described above with reference to preferred embodiments. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A garment, comprising:

a brassiere having first and second breast-receiving cups each cup having a shape, an inner breast-receiving surface, and an opposing outer surface forming an area;

a pocket component having a perimeter edge defining a shape of the pocket component and a perimeter size of the pocket component;

the pocket component opposing a portion of the outer surface of the first breast-receiving cup and affixed to the outer surface of the first breast-receiving cup;

the pocket component and the portion of the outer surface of the first breast-receiving cup forming a storage pocket and an opening into the storage pocket; and a writing surface substrate in the storage pocket to accept writing applied thereto by a writing instrument, the substrate being removable from the storage pocket through the opening;

wherein the storage pocket is smaller than and within the area covered by the outer surface of the first breast-receiving cup, the perimeter size of the pocket component is smaller than and within the area covered by the outer surface of the first breast-receiving cup, and the shape of the pocket component defined by the perimeter edge thereof is different than the shape of the first breast-receiving cup visually distinguishing the pocket component relative to the area covered by the outer surface of the first breast-receiving cup.

2. A garment, comprising:

a brassiere having first and second breast-receiving cups each having a shape, an inner breast-receiving surface, and an opposing outer surface forming an area;

a pocket component having a perimeter edge defining a shape of the pocket component and a perimeter size of the pocket component;

the pocket component opposing a portion of the outer surface of the first breast-receiving cup and affixed to the outer surface of the first breast-receiving cup; and the pocket component and the portion of the outer surface of the first breast-receiving cup forming a storage pocket and an opening into the storage pocket;

wherein the storage pocket is smaller than and within the area covered by the outer surface of the first breast-receiving cup, the perimeter size of the pocket component is smaller than and within the area covered by the outer surface of the first breast-receiving cup, and the shape of the pocket component defined by the perimeter edge thereof is of a decorative shape being different than the shape of the first breast-receiving cup visually distinguishing the pocket component relative to the area covered by the outer surface of the first breast-receiving cup to receive a writing substrate of a like shape.

* * * * *